US011717089B2

(12) United States Patent
Lazar et al.

(10) Patent No.: US 11,717,089 B2
(45) Date of Patent: Aug. 8, 2023

(54) MULTIPLE SITTING POSITION CHAIR

(71) Applicant: Lost Luggage ID Limited, Hong Kong (HK)

(72) Inventors: Daniel Lazar, Hong Kong (HK); Sam Adedamola Olawale, Hong Kong (HK)

(73) Assignee: LOST LUGGAGE ID LIMITED, Hong Kong (HK)

( * ) Notice: Subject to any disclaimer, the term of this patent is extended or adjusted under 35 U.S.C. 154(b) by 0 days.

(21) Appl. No.: 17/505,488

(22) Filed: Oct. 19, 2021

(65) Prior Publication Data

US 2022/0125205 A1 Apr. 28, 2022

Related U.S. Application Data

(60) Provisional application No. 63/104,683, filed on Oct. 23, 2020.

(51) Int. Cl.

| | |
|---|---|
| ***A47C 1/024*** | (2006.01) |
| ***A47C 1/03*** | (2006.01) |
| ***A47C 7/40*** | (2006.01) |
| ***A47C 7/44*** | (2006.01) |
| ***A47C 7/54*** | (2006.01) |
| ***A47C 7/14*** | (2006.01) |
| ***A47C 13/00*** | (2006.01) |
| ***A47C 7/02*** | (2006.01) |
| ***A47C 7/48*** | (2006.01) |

(52) U.S. Cl.

CPC ..... *A47C 7/14* (2013.01); *A47C 1/0244* (2013.01); *A47C 1/03* (2013.01); *A47C 1/0308* (2018.08); *A47C 7/024* (2013.01); *A47C 7/407* (2013.01); *A47C 7/44* (2013.01); *A47C 7/48* (2013.01); *A47C 7/54* (2013.01); *A47C 7/541* (2018.08); *A47C 7/543* (2013.01); *A47C 13/00* (2013.01)

(58) Field of Classification Search

CPC ..... A47C 7/024; A47C 1/0244; A47C 7/407; A47C 7/44; A47C 7/48; A47C 1/03; A47C 1/0308; A47C 7/54; A47C 7/541; A47C 7/543

USPC ..... 297/107, 116, 232, 233, 234, 235, 353, 297/354.11, 411.32, 411.37, 411.38

See application file for complete search history.

(56) References Cited

U.S. PATENT DOCUMENTS

| | | | | | |
|---|---|---|---|---|---|
| 90,613 | A | * | 5/1869 | Vogeletal | A47C 7/024 297/233 X |
| 137,062 | A | * | 3/1873 | Croghan | A47C 17/12 297/119 |
| 156,177 | A | * | 10/1874 | Schabeletal | A47C 17/12 297/116 |

(Continued)

FOREIGN PATENT DOCUMENTS

| | | | | | |
|---|---|---|---|---|---|
| CN | 112890486 | A | * | 6/2021 | A47C 1/0308 |

*Primary Examiner* — Rodney B White

(74) *Attorney, Agent, or Firm* — L/O of Alexis J Saenz

(57) ABSTRACT

A reconfigurable chair includes features that open up new sitting and resting positions for the user. The chair includes rotatable lateral side rests and a tilt adjustable back rest which when reconfigured, provide auxiliary resting platforms to support the body in different sitting and resting positions. The backrest may include a rotatable feature so that the backrest may be moved from an upright position to a flat position adding another level of support. A height adjustment mechanism may adjust the height of the backrest to add to the reconfigurability of the chair.

14 Claims, 8 Drawing Sheets

(56) References Cited

U.S. PATENT DOCUMENTS 352,723 A * 11/1886 Weeden ..... B60N 2/3084 297/112
863,874 A * 8/1907 Rajner ..... A47C 17/18 297/411.27
1,025,266 A * 5/1912 Harman ..... A47C 17/12 297/116
2,053,349 A * 9/1936 Nordmark ..... B60N 2/3043 297/116
2,790,485 A * 4/1957 Llewellyn ..... A47C 17/12 297/116
3,837,704 A * 9/1974 Bauer ..... A47C 1/0244 297/353 X
3,880,465 A * 4/1975 Scheben ..... A47C 1/0244 297/354.1 X
4,364,605 A * 12/1982 Meiller ..... A47C 1/0244 297/354.12 X
4,370,001 A * 1/1983 Ornberg ..... A47C 1/0244 248/188.7
4,408,800 A * 10/1983 Knapp ..... A47C 1/0244 297/285
4,589,697 A * 5/1986 Bauer ..... A47C 1/022 297/301.2
4,632,458 A * 12/1986 Brown ..... A47C 7/402 297/353 X
4,662,681 A * 5/1987 Favaretto ..... A47C 7/402 297/353 X
4,830,432 A * 5/1989 Fuhrmann ..... A47C 1/0244 297/303.2
5,882,069 A * 3/1999 Gunnett ..... A47B 85/04 297/354.11
6,773,059 B2 * 8/2004 Volotsenko ..... A61G 5/125 297/233 X
6,883,863 B2 * 4/2005 Ginns ..... A47C 7/70 297/354.11
7,093,904 B1 * 8/2006 McMillen ..... A47C 7/543 297/411.32
7,347,496 B1 * 3/2008 Wang ..... A47C 1/023 297/354.11 X
9,693,634 B2 * 7/2017 Smith ..... A47B 83/021
10,427,552 B2 * 10/2019 Guy ..... B60N 2/58
10,765,218 B2 * 9/2020 Donati ..... A47C 7/40
10,874,574 B1 * 12/2020 Ruby ..... A61G 15/02
10,912,423 B2 * 2/2021 Williams ..... A47K 3/282
2005/0179291 A1 * 8/2005 Brodeur ..... A47C 9/002 297/284.9
2007/0126271 A1 * 6/2007 Brodeur ..... A47C 7/024 297/311
2007/0290539 A1 * 12/2007 Hosoe ..... A47C 1/023 297/354.11
2010/0164266 A1 * 7/2010 Walters ..... B60N 2/666 297/354.11
2016/0227931 A1 * 8/2016 Ledat ..... A47C 3/30
2019/0082848 A1 * 3/2019 McClintock ..... A47C 7/5064

* cited by examiner

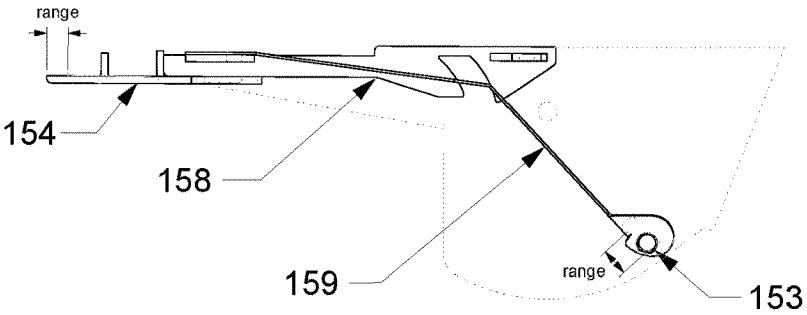
FIG.7 Unlocked position
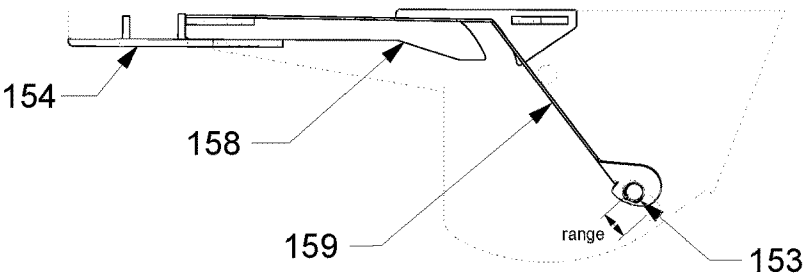
FIG.6 Locked position
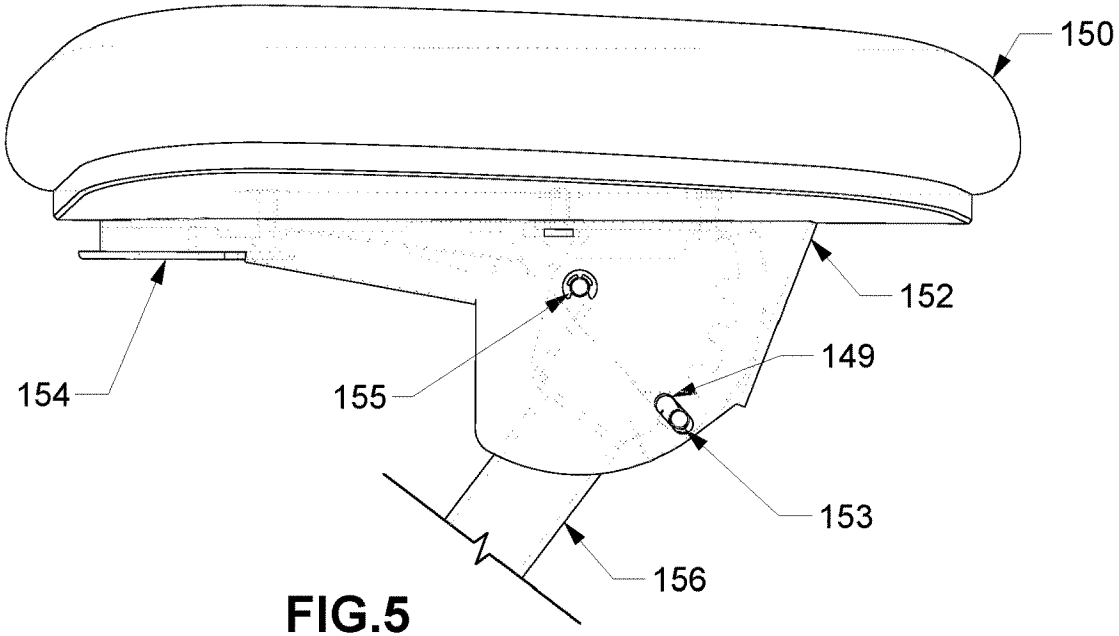
FIG.5

MULTIPLE SITTING POSITION CHAIR

CROSS-REFERENCE TO RELATED APPLICATION

This application claims benefit under 35 U.S.C. § 119(e) of U.S. Provisional Application having Ser. No. 63/104,683 filed Oct. 23, 2020, which is hereby incorporated by reference herein in their entirety.

FIELD

The subject disclosure relates to furniture, and more particularly, to a multiple sitting position chair.

BACKGROUND

Chairs generally have static elements. Conventional chairs generally have only one sitting position, with no real adjustment capabilities other than to raise and lower the height of the seat or control lumbar support. However, the person sits in the same general position even with adjustments to these features. Sitting in the same positions for extended periods of time negatively impacts each person's comfort and performance

SUMMARY

In one aspect of the disclosure, a reconfigurable chair is disclosed. The reconfigurable chair includes a base and a seat coupled to the base. A backrest is coupled to the seat. At least one side mounted rest is coupled to the seat. The side mounted rest is positioned laterally to the seat. A hinge couples the side mounted rest to the seat. The side mounted rest rotates upwardly around a first axis of rotation, from a first position to a second position. The first position is at an obtuse angle with an edge of the seat and the second position is at an acute angle with the edge of the seat.

In another aspect, a reconfigurable chair is disclosed which includes a base, a seat coupled to the base, a post coupled to the seat, a backrest coupled to the post, and hinge coupled to the post and to the backrest. The backrest is configured to rotate around the hinge from a first, upright position, to a second, flat position.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

FIG. 5 is an enlarged, partial side view of the back rest of FIG. 4 according to an embodiment.

FIG. 6 is an enlarged, internal, side view of an adjustment and locking mechanism for the back rest of FIG. 5, in a locked position, in accordance with embodiments.

FIG. 7 is an enlarged, internal, side view of an adjustment and locking mechanism for the back rest of FIG. 5, in an unlocked position, in accordance with embodiments.

DETAILED DESCRIPTION

Figure 1:
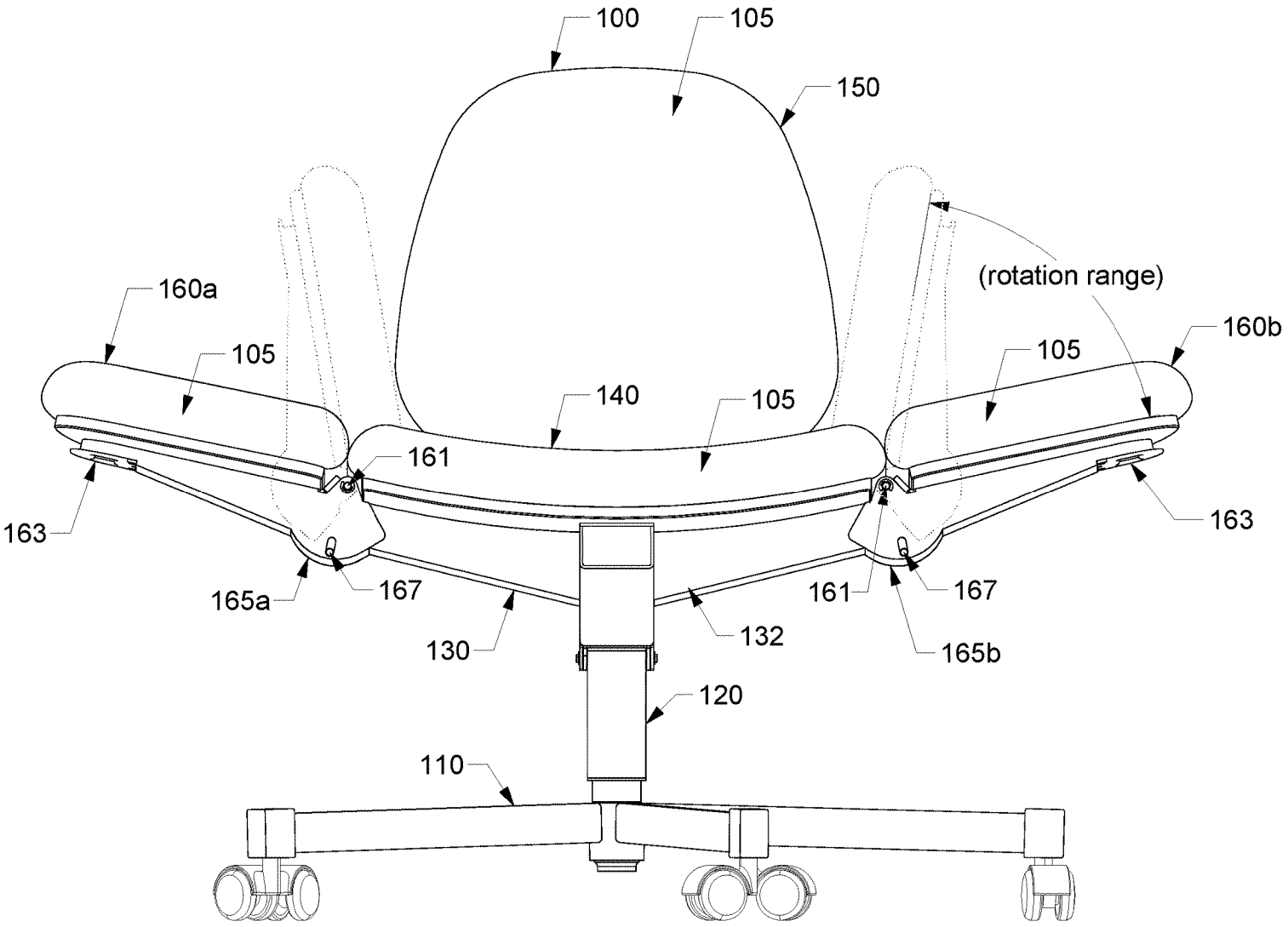
FIG. 1 is a front view of a reconfigurable chair in accordance with an aspect of the subject technology showing a hinge feature for lateral wing portions of the chair.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, and referring to the Figures, exemplary embodiments of the subject technology comprise a reconfigurable chair, which includes aspects that provide multiple sitting positions for the user. As will be appreciated, features of the subject chair provide various modes of comfort for users. Users may enjoy sitting in different positions rather than a static position that is restricted by the design of conventional chairs. More than ten different sitting and resting positions become available through repositioning of the elements of the chair. Thus, the user is no longer restricted to the conventional feet on the ground and back against the backrest position.

As shown in FIGS. 1-13, a reconfigurable chair 100 is shown according to an exemplary embodiment. The reconfigurable chair 100 generally includes a base 110, a central seat 140, a back rest 150, and a pair of side mounted rests 160*a* and 160*b* (referred to generally sometimes as "the side mounted rests 160" or "rests 160"), according to an exemplary embodiment. One or more of the seat 140, the backrest 150, and/or side mounted rests 160 may include a padding or cushion 105. In some embodiments, the top surface of the seat 140 may include a curve or contour that gradually rises from the seat's center to the seat edges. Some embodiments may include a telescoping post 120 connecting the base 110 to the seat 140. Embodiments may include a support frame 130 for holding the seat 140 and the side mounted rests 160. The seat 140 may be supported by a central frame support 132. In an exemplary embodiment, the backrest 140 and rests 160 have rotatable features which open up new positions for sitting/resting in a single chair that is unavailable in other chairs.

Referring to FIGS. 1-7, the reconfigurable chair 100 is shown with features that make the backrest 150 adjustable into various configurations that a user will find convenient for different modes of sitting and resting.

Figure 2:
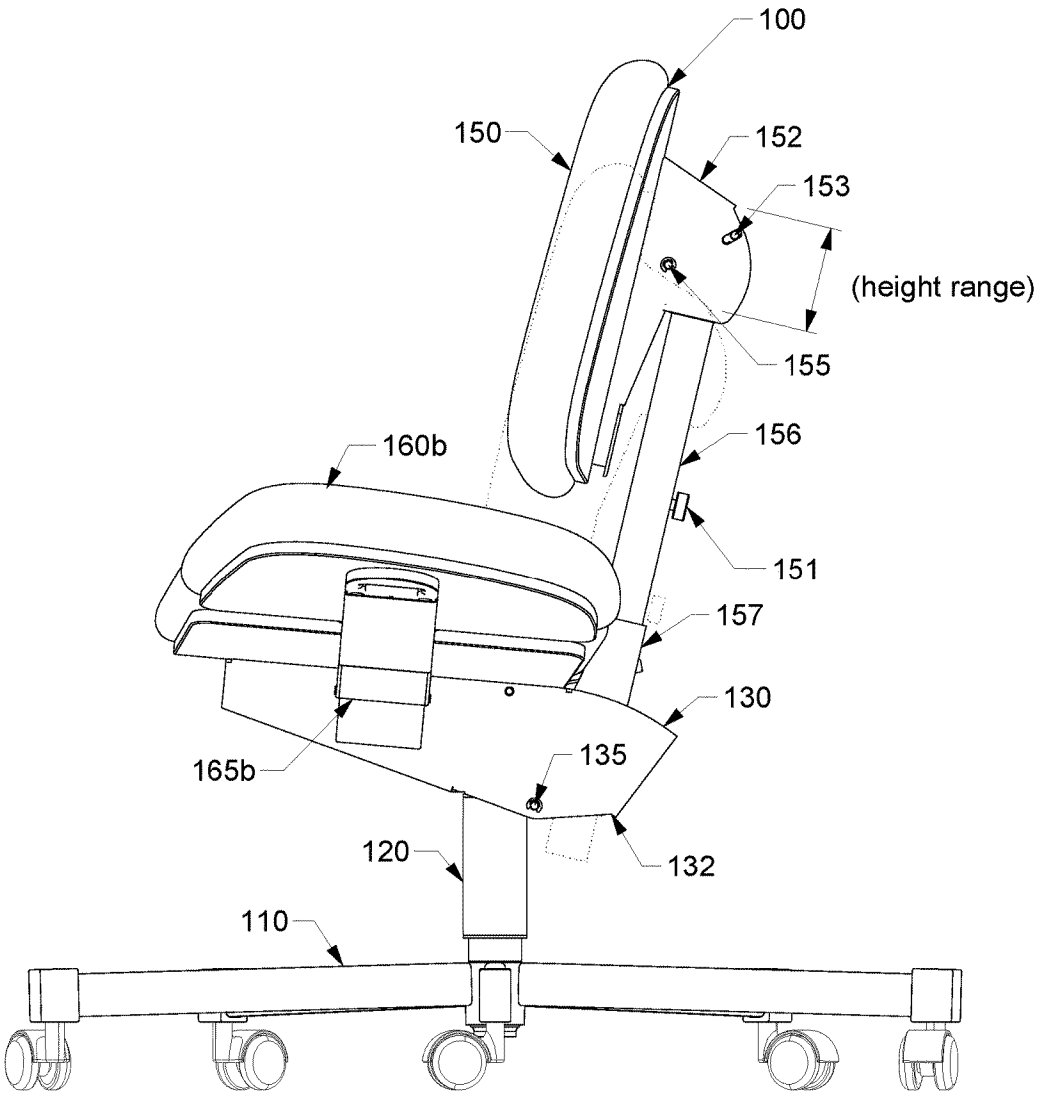
FIG. 2 is a left side view of the chair of FIG. 1 showing elements for adjusting a height of the back rest in accordance with embodiments.

FIG. 2 shows an embodiment with features that permit height adjustment of the backrest 150. Embodiments may generally include a post 156 supporting the backrest 150. Height adjustment of the backrest 150 may occur along the line of the post 156. The backrest 150 may include an upper housing 152, to which the post 156 is attached. The housing 152 may be enclosed or have an open back or top (for example, as in a clamp). In enclosed housing embodiments, the height of the housing 152 may define the range of height adjustment. In some embodiments, the housing 152 together with the post 156 slide down through the lower support frame 157. The support frame 157 is connected to 130. A trigger or action button 151 may be positioned on the post 156. Operation of the trigger button 151 may actuate movement of the housing 152 (by a spring, set screw release, or other locking mechanism).

Figure 3:
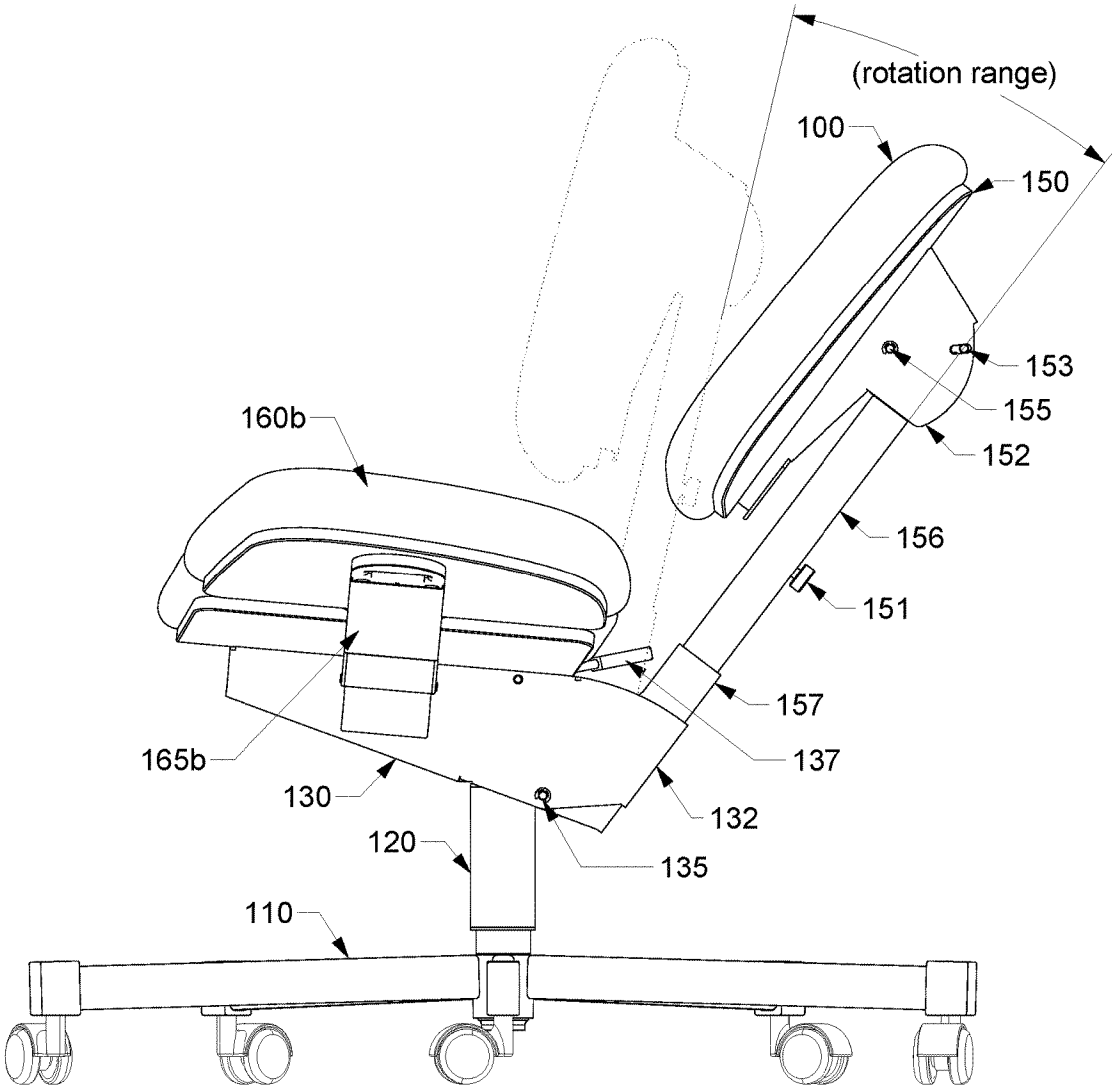
FIG. 3 is a left side view of the chair of FIG. 1 showing elements for tilting a back rest in accordance with embodiments.
Figure 11:
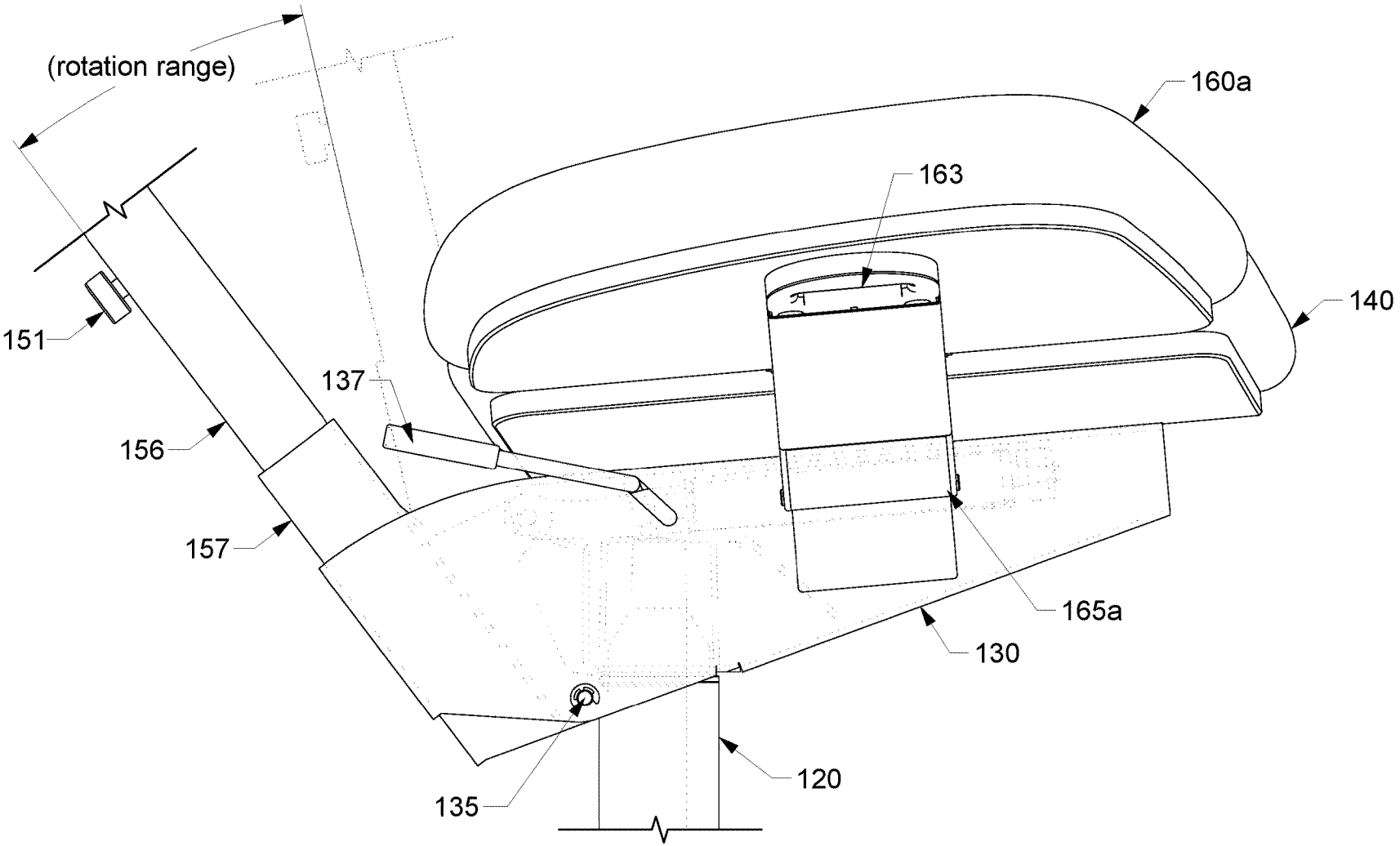
FIG. 11 is a partial, perspective, right side view of the chair of FIG. 1 showing elements for tilting a back rest in accordance with embodiments according to embodiments.
Figure 12:
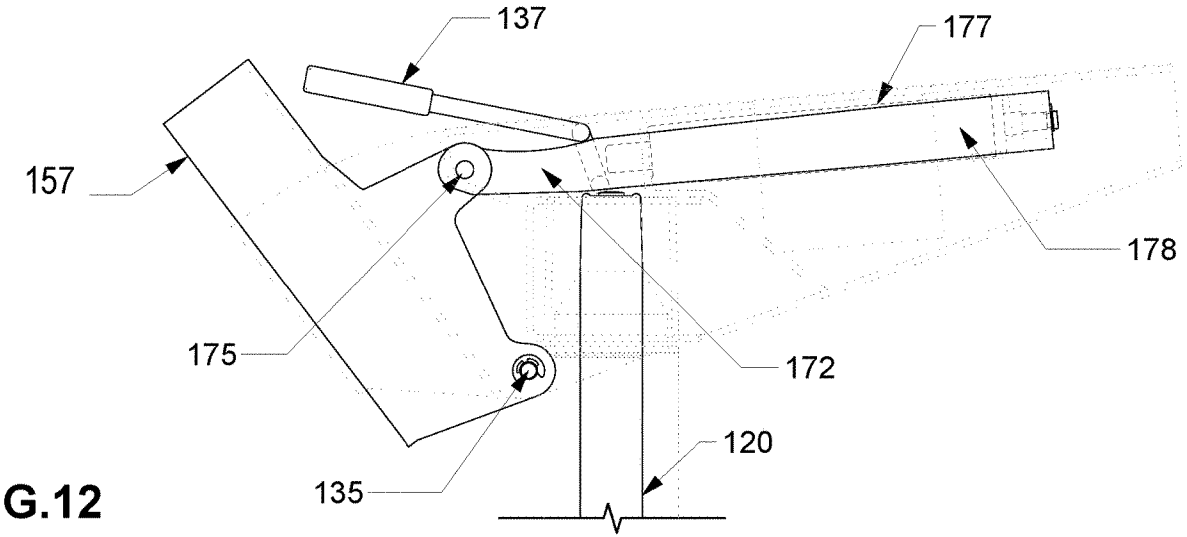
FIG. 12 is a left side view of internal elements in FIG. 11, for adjusting the tilt of the chair, when the chair is in a tilted position, according to an embodiment.
Figure 13:
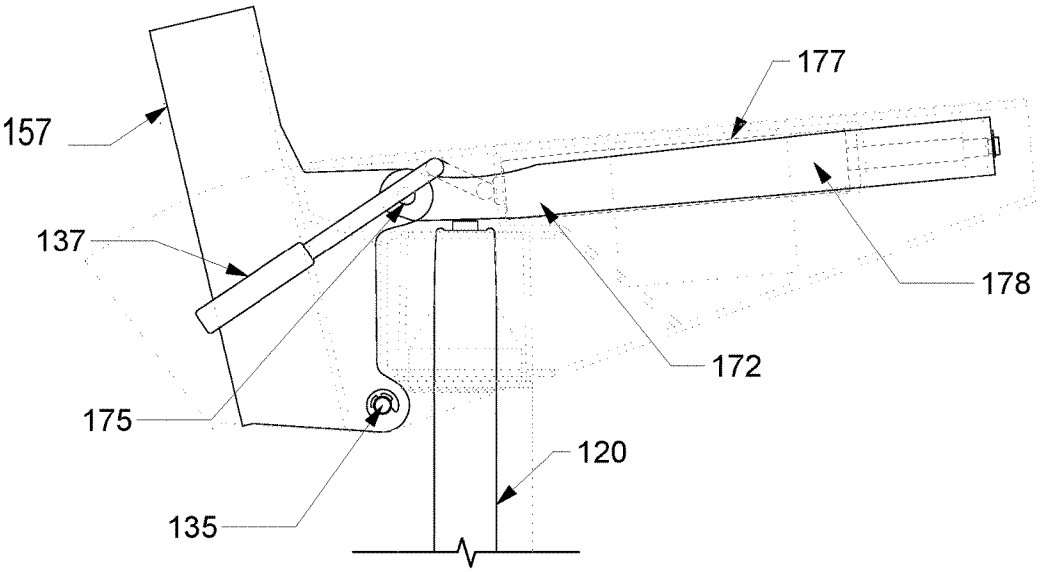
FIG. 13 is a left side view of internal elements in FIG. 11, for adjusting the tilt of the chair, when the chair is in a default or un-tilted position, according to an embodiment.

Referring now to FIGS. 3 and 11-13, an embodiment of the reconfigurable chair 100 with a tilt adjustment feature is shown. In some embodiments, the post 156 may tilt forward or backward within the support frame housing 130 by control of an action handle 137. FIGS. 11-13 show the internal features within the support frame housing 130 that are connected to the action handle 137. Embodiments may include a support frame 157 that holds the bottom end of the post 156. The support frame 157 may be connected to a hinge 175, which in turn may be connected to an end of a gas piston 178 (housed with piston casing 177). Actuating the handle 137 operates the gas piston 178 to extend or retract. Support bracket 157 rotates around hinge 135. Hinge 135 is the rotation center for the tilting mechanism. Some embodiments include hinge 175 as a secondary pivot point that translates the linear motion of gas piston 178 into rotational motion of the support frame 157. An example range of rotation for tilting of the backrest 150 is shown in FIG. 3.

Figure 4:
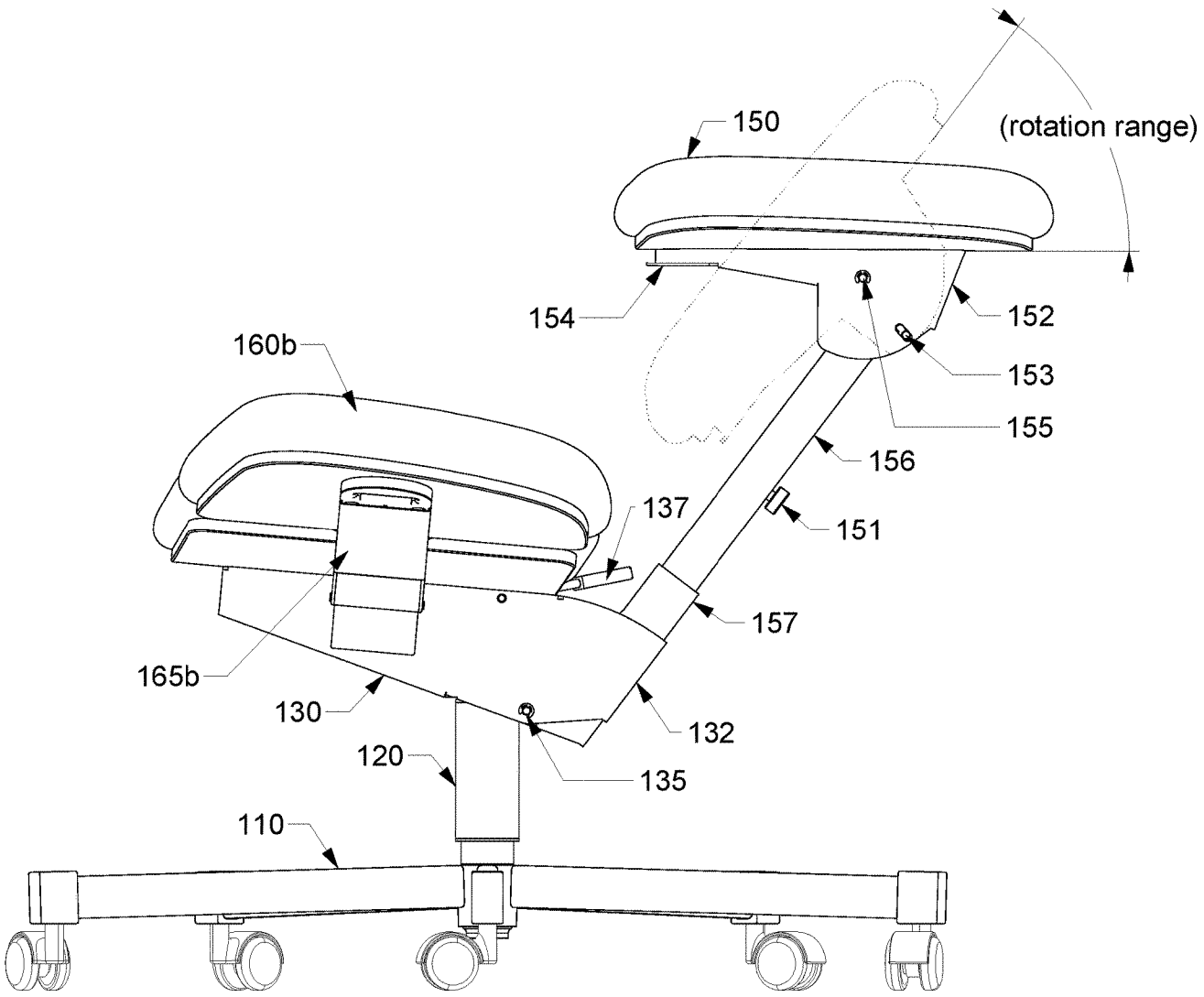
FIG. 4 is a left side view of the chair of FIG. 1 showing elements for rotating the back rest in accordance with embodiments.

Referring now to FIGS. 4-7, features providing a rotatable backrest 150 are shown according to an exemplary embodiment. It will be appreciated that the backrest 150 may be rotated from a default upright position (against which a user may support their back or in some configurations of the reconfigurable chair 100, their side), to a flat (horizontal with respect to the underlying floor or parallel to the seat 140) position. FIG. 4 shows the default position in broken lines (which is the same position shown in FIGS. 1-3). In solid lines, the backrest 150 is depicted having been rotated into the flat position. The upper housing 152 may include a hinge 155. When the user wishes to rotate the backrest 150, the user may grasp a handle 154, and releases a lock pin 153 which secures the position of the backrest 150 into place. The handle 154 may be pulled to rotate the backrest 150 around the axis defined by the hinge 155 until the front surface of the backrest 150 is facing upward. FIGS. 5-7 show the internal elements of the housing 152 which control the rotation of the backrest 150.

In some embodiments, the handle 154 may be connected to the lock pin 153 by a sliding (or push/pull) cam 158. Some embodiments may include a flat spring 159 connecting one end of the sliding cam 158 to the lock pin 153. The lock pin 153 may travel within a slot 149 of the housing 152. When the user pulls on the handle 154, the sliding cam 158 pulls on the spring 159. The end of the spring 159 connected to the lock pin 153 pulls the lock pin 153 within the slot 149 to release from engagement with the post 156. The backrest may then rotate around the axis of hinge 155. In some embodiments, the backrest 150 may be rotated into multiple positions between upright and fully flat within, for example, the range shown in FIG. 4.

It will be appreciated that rotation of the backrest 150 provides an unexpected new configuration for sitting and resting. The features connected to the backrest 150 provide sufficient strength for supporting the weight of a person. In the flat position, the user may sit on the backrest 150 for an elevated seating position. In another exemplary use, the backrest 150 may be used as an arm rest or support for a device when the user sits sideways on the seat 140 or on one of the side mounted rests 160 (discussed further below). The user may also sit backwards on the seat 140 making the backrest 150 in the flat state, a support for their arms or other object. In addition, by making the range of rotation for the backrest 150 adjustable, the backrest 150 may be converted into various positions of use and comfort. For example, in one application, by adjusting the height of the backrest 150, the tilt angle, and the magnitude of rotation, the back rest 150 may become another type of support including for example, a head rest of various tilted positions. Accordingly, a variety of new seating/resting alternatives to sitting on the center of a chair becomes available to end users.

Figure 10:
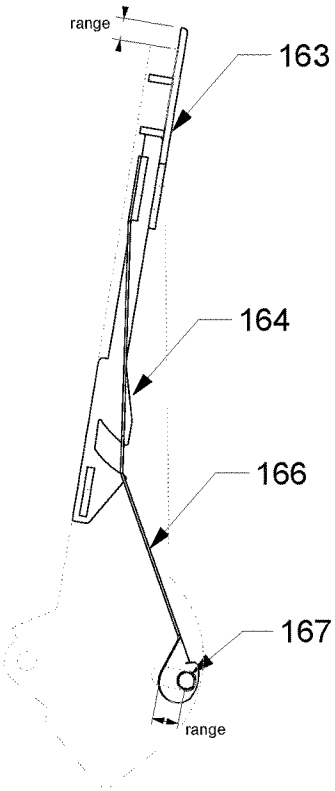
FIG. 10 is an enlarged, internal, front view of an adjustment and locking mechanism for the lateral rest pad of FIG. 8, in an unlocked position, in accordance with embodiments.
Figure 9:
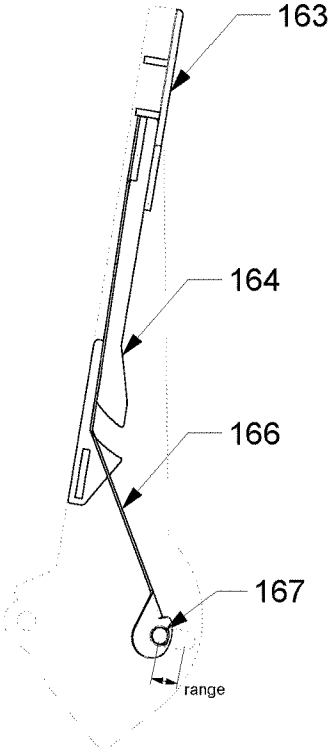
FIG. 9 is an enlarged, internal, front view of an adjustment and locking mechanism for the lateral rest pad of FIG. 8, in a locked position, in accordance with embodiments.
Figure 8:
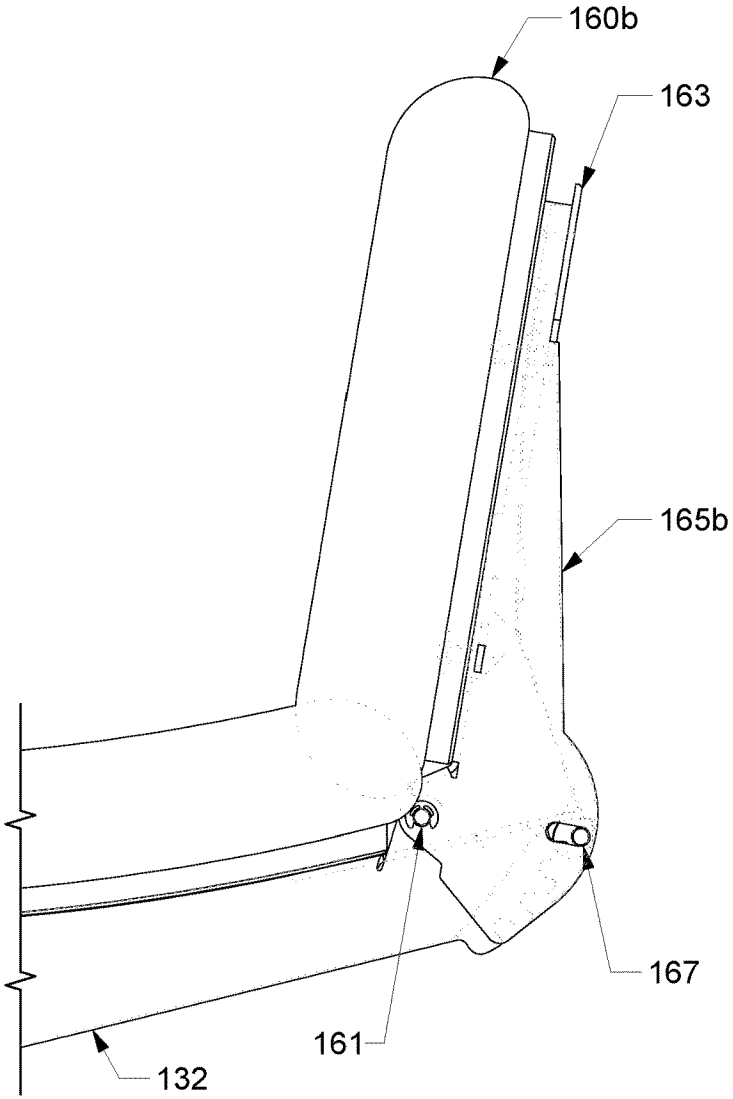
FIG. 8 is an enlarged, partial front view of a right side lateral rest pad according to embodiments.

Referring now to FIGS. 1-4 and 8-10, features providing rotatable side mounted rests 160 are shown according to an exemplary embodiment. The side mounted rests 160 of the subject chair 100 generate additional new configurations for sitting and resting. FIG. 1 shows a front view of the reconfigurable chair 100 in an embodiment that includes a pair of side mounted rests **160*a* (left side from the perspective of the viewer) and 160*b* (right side from the perspective of the viewer). FIGS. 8-10 show an enlarged view of a single, side mounted rest 160*b*. For sake of illustration the details of side mounted rest are not shown enlarged, but it will be understood that in embodiments, the features of side mounted rest 160*a* mirror the features of side mounted rest 160*b*. Accordingly, the side mounted rest 160*b* will be referred to generally or interchangeably as the "side mounted rest 160**".

In some embodiments, an inside edge of the side mounted rest 160 may be coupled to an outside edge of the seat 140. For example, the side mounted rest may be supported by a lateral frame support **165*b*. The lateral frame support 165*b* may be connected to the central frame support 132. In an exemplary embodiment, a hinge 161 connects the lateral frame support 165*b* to the central frame support 132. The hinge 165*b* defines an axis of rotation for moving the side mounted rest 160** from a default, generally flat position, to an upright position.

The generally flat position is shown in FIG. 1. The flat position is defined as the bottom surface of the side mounted rest 160 (for example, a top surface of the lateral frame support **165*b*) being at an obtuse angle from the bottom surface of the seat 140 (for example, a top surface of the central frame support 132). In an exemplary embodiment, the side mounted rest 160 may not necessarily be completely parallel to the ground. For example, in some embodiments, the side mounted rests may be aligned with or follow a slope that originated from the seat 140 and gradually rises from the connection of the side mounted rest 160 to the seat 140 and continues to slope upward to the outer edge of the side mounted rest 160. See FIG. 1. The slope may be defined by the configuration of the underlying central frame support 132 and lateral frame support 165***b*. As will be appreciated, the contour or slope of the side mounted rest 160 adds to comfort and ergonomics for the user when the user is supported by the side mounted rest 160. In embodiments with a pair of side mounted rests 160, a user may lay across the span of the side mounted rests 160 and seat 140.

The generally upright position is shown in broken lines in FIG. 1 and in solid lines in FIG. 8. In the upright position (or any position between flat and upright), the side mounted rest may provide back support for the user as an alternative to the backrest 150. In some embodiments, the lateral frame support 165*b* may include on its distal edge, a handle 163.

The range of rotation between flat and upright may be controlled by the user so that intermediate positions of rotation for the side mounted rest 160 is possible. The position of the side mounted rest 160 may be controlled by actuation of a lock pin 167 in the lateral frame support 165*b*. The internal elements within the lateral frame support 165*b* are shown in FIGS. 9-10 according to an exemplary embodiment. The handle 163 may be connected to the lock pin 167 through a sliding cam (or push/pull) 164. The cam 164 may be connected to a flat spring 166 which may be connected to the lock pin 167. Pulling on the handle 163 may actuate the cam spring 166 to move within the cam 164, disengaging the lock pin from a locked position into an unlocked position, freeing the lateral frame support 165*b* to rotate around the axis of the hinge 161.

Referring temporarily back to FIGS. 1, 2, and 12, it can be seen that the reconfigurable chair 100 has hinges (135, 155, and 161) arranged along different axes. The hinge 161 is positioned to rotate around an axis that points from the front of the chair to the rear of the chair. The hinges 155 and 135 are positioned to rotate around axes that point from a left side of the chair to the right side of the chair or vice versa. Relative to each other, the axis for hinge 161 may be transverse to the axis for hinge 155 and may be transverse to the axis for hinge 135. The axis for hinge 155 may be parallel to the axis for hinge 135.

Those of skill in the art would appreciate that various components may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A reconfigurable chair, comprising:

a base;

a seat coupled to the base;

a rotatable backrest coupled to the seat;

a side mounted rest coupled to the seat, wherein, the side mounted rest is positioned laterally to the seat;

a first hinge coupling the side mounted rest to the seat, wherein:

the side mounted rest rotates upwardly around a first axis of rotation, defined by the first hinge, from a first position to a second position and to an indefinite number of positions between the first position and the second position, and the first position is at an obtuse angle with an edge of the seat and the second position is at an acute angle with the edge of the seat;

a first housing coupled to the backrest;

a second housing coupled to the seat;

a post, wherein a first end of the post is coupled to the first housing and a second end of the post is coupled to the second housing;

a second hinge located in the first housing, wherein:

the second hinge defines a second axis of rotation, the second axis of rotation is transverse to the first axis of rotation, the second hinge is coupled to the backrest, triggering an operation of the second hinge causes the backrest to rotate around the second axis of rotation, from a position perpendicular to a top surface of the seat, to a position parallel with the top surface of the seat and positions anywhere in between the position perpendicular to the top surface of the seat and the position parallel with the top surface of the seat;

a third hinge located in the second housing, wherein:

the third hinge defines a third axis of rotation, the third axis of rotation is transverse to the first axis of rotation and parallel to the second axis of rotation, the third hinge is coupled to the post, triggering an operation of the third hinge causes the backrest to tilt in a range, away from or toward, the seat in a direction defined by the third axis of rotation, the backrest is position able anywhere within the range, and the back rest, in the position parallel with the top surface of the seat, and the seat, support a person sitting on the backrest in cooperation with the backrest being tilted away from the seat.

2. The reconfigurable chair of claim 1, further comprising:

a gas piston coupled to the third hinge, wherein an actuation of the gas piston controls the range of tilt.

3. The reconfigurable chair of claim 1, wherein the backrest is configured to move up or down, along a length of, or in line with, the post.

4. The reconfigurable chair of claim 1, wherein the backrest, in the position parallel to the seat, is positioned higher than the seat.

5. The reconfigurable chair of claim 1, wherein the backrest includes a cushion.

6. The reconfigurable chair of claim 1, wherein the side mounted rest includes a cushion.

7. The reconfigurable chair of claim 1, further comprising:

a lock, wherein the lock is configured to secure the side mounted rest in an upright position.

8. A reconfigurable chair, comprising:

a base;

a seat coupled to the base;

a post coupled to the seat;

a backrest coupled to the post;

a first hinge coupled to the post and to the backrest, wherein the backrest is configured to rotate around the first hinge from a first, upright position of the backrest, to a second, flat position of the backrest;

a pair of side mounted rests coupled to the seat, each side mounted rest includes a second hinge, wherein:

a first of the side mounted rests is positioned on a left side of the seat, the second side mounted rest is positioned on a right side of the seat, and the first side mounted rest or the second side mounted rest is rotatable around an axis of the second hinge in positions including:

a first, upright position of the first or second side mounted rest, a second, flat position of the first or second side mounted rest, and an indefinite number of positions between the first, upright position of the first or second side mounted rest and the second, flat position of the first or second side mounted rest.

9. The reconfigurable chair of claim 8, wherein each side mounted rest is configured to pivot from a respective edge of each side mounted rest coupled to the seat.

10. The reconfigurable chair of claim 9, wherein the first side mounted rest pivots independently of the second side mounted rest.

11. The reconfigurable chair of claim 8, wherein the side mounted rests, in a first position relative to the seat, a top surface of each side mounted rest follows a slope in alignment with a top surface of the seat.

12. The reconfigurable chair of claim 8, further comprising a rotation point in a housing coupled to a support frame of the seat, wherein the backrest is configured to tilt forward or backward from the seat, in a range defined by the rotation point.

13. The reconfigurable chair of claim 8, further comprising a height adjustment element coupling the backrest to the post, wherein a height position of the backrest is adjustable by operation of the height adjustment mechanism.

14. The reconfigurable chair of claim 8, wherein at least one side mounted rest is configured to pivot upright while the backrest is positioned in the second, flat position.

* * * * *